United States Patent [19]

LaRue

[11] 4,302,898

[45] Dec. 1, 1981

[54] INDIVIDUAL SAFETY FIRING BUTTON FOR GUNS

[76] Inventor: Earl P. LaRue, 884 Murray Rd., Jerome, Mich. 49249

[21] Appl. No.: 37,355

[22] Filed: May 9, 1979

[51] Int. Cl.[3] ..... F41C 17/00

[52] U.S. Cl. ..... 42/1 LP

[58] Field of Search ..... 42/1 LP, 70 E, 69 R

[56] References Cited

U.S. PATENT DOCUMENTS

| | | | |
|---|---|---|---|
| 667,051 | 1/1901 | Ackerman | 42/1 LP |
| 2,599,132 | 6/1952 | Sass | 42/1 Y |
| 2,945,316 | 7/1960 | Mulno | 42/1 LP |
| 3,018,576 | 1/1962 | Riechers | 42/1 LP |
| 3,210,879 | 10/1965 | LaRue | 42/69 R |
| 3,553,877 | 1/1971 | Welch et al. | 42/1 LP |
| 3,634,963 | 1/1972 | Hermann | 42/1 LP |
| 3,735,519 | 5/1973 | Fox | 42/1 LP |

*Primary Examiner*—Charles T. Jordan

*Attorney, Agent, or Firm*—Victor J. Evans & Co.

[57] ABSTRACT

A lock is provided on the stock of a gun defined by a plurality of buttons some of which must be simultaneously depressed in order to release a safety lever so that the lever can be moved from a locked to an unlocked position permitting the firing of the gun either through a trigger or by means of the safety lever.

7 Claims, 6 Drawing Figures

INDIVIDUAL SAFETY FIRING BUTTON FOR GUNS

BACKGROUND OF THE INVENTION

Field of the Invention

While the present invention is especially desirable on guns having a firing button such as seen in U.S. Pat. No. 3,210,879, it is not limited in use to that sort of gun but may be used in any gun provided with a pivoted locking lever which in one position prevents the trigger from operating to fire the gun, but when swung to another position the trigger may be operated.

It is an object of the present invention to provide a lock for a gun which depends, for use of the gun on, knowledge of which several buttons must be simultaneously depressed to permit the safety catch to be swung from the locked to the safety and then to the firing position.

Other and further objects and advantages will appear from the following specification taken with the accompanying drawings in which like reference characters refer to similar parts in the several views.

DESCRIPTION OF THE PREFERRED EMBODIMENT

Figure 1:
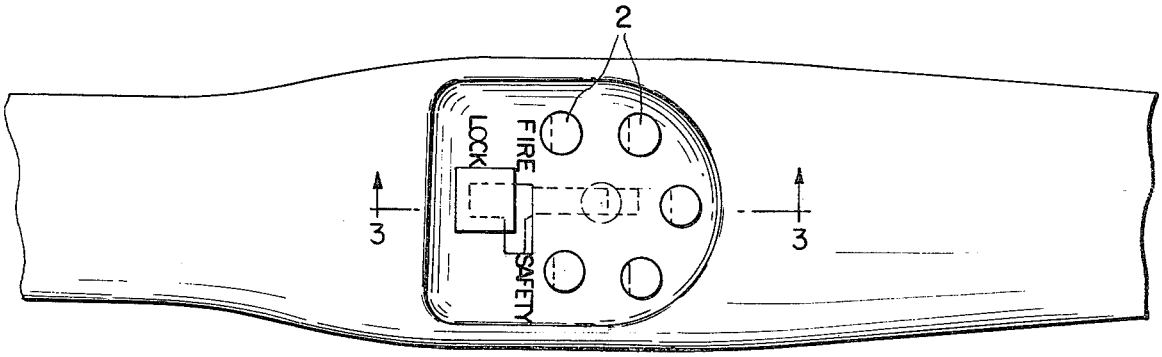
FIG. 1 is a top plan view of the lock and safety according to the present invention.
Figure 2:
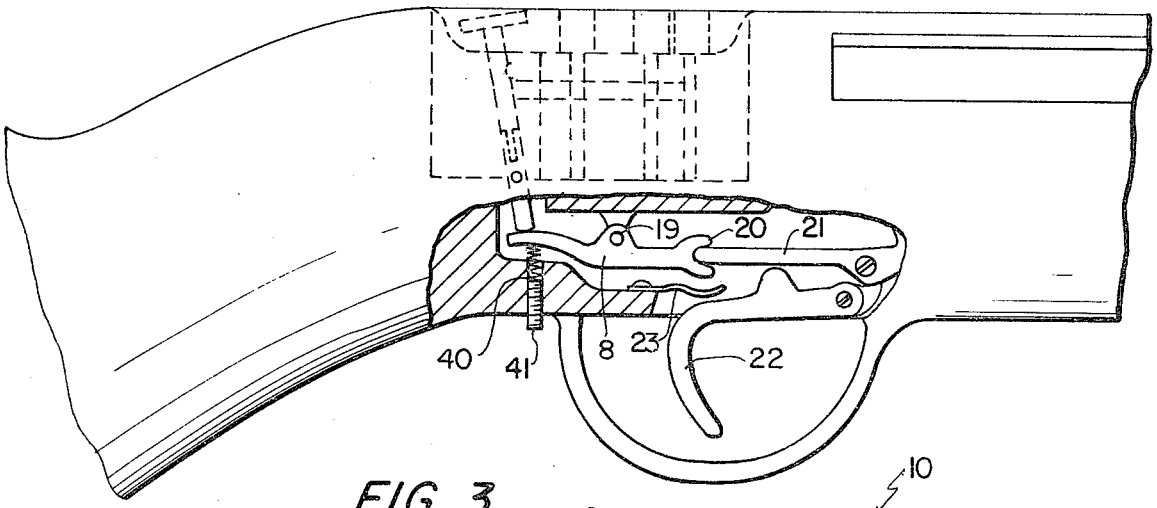
FIG. 2 is a side view thereof with a cut away portion showing the trigger actuating mechanism and the lock structure in phantom.

Referring to the drawings now, wherein like reference numerals refer to like parts throughout the several drawings, reference numeral 10 is directed to the gun lock according to the present invention.

This gun lock 10 may generally be regarded as being provided with a trigger 22 adapted to coact with a seer 21. One extremity of the seer is pivoted and the extremity remote therefrom is provided with a terminal portion adapted to coact with a lever 8 in a manner now to be defined. Lever 8 is pivoted at point 19 and the extremity proximate to the seer has a bifurcated terminus 20. The extremity remote from the seer is provided with a bias link in which a spring 40 is disposed at the bottom face of the extremity and a set screw 41 is disposed there below so as to provide the proper tensioning. A second spring 23 exists proximate to the trigger 22 and provides a normally downwardly biased force so that the trigger must work against the biasing to discharge the weapon. On top of lever 8 and substantially aligned with spring 40 there is provided the firing button 1 in which the internal portion proximate to the lever 8 is denoted by reference numeral 6. Between the top portion of the gun firing button 1 and its terminal extremity 6 there are provided several components fastened to assure that this button can not only provide the locking and unlocking and safety mechanisms, but can also initiate the actual discharge of the weapon.

When the button in shaft 1, 6 are in the safety position, the downward disposition of the button is retarded by the coaction of dimple 9 disposed on the gun lock and it's associated registry with notch 11 disposed on shaft 6. Negative vertical displacement of the button is therefor impossible because of this coaction.

Figure 3:
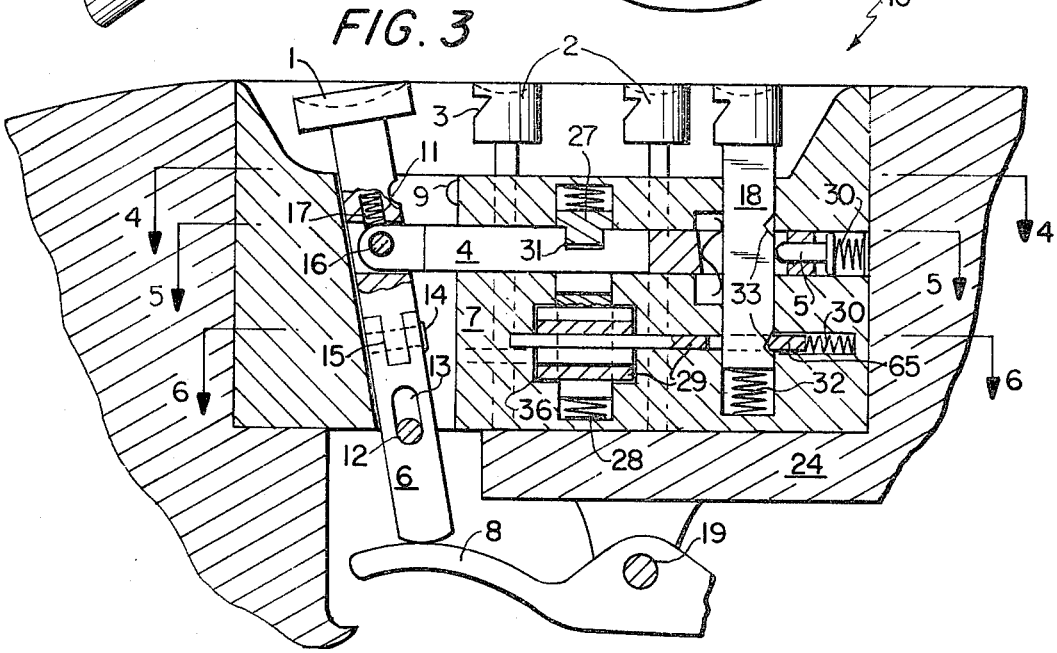
FIG. 3 is a sectional view taken along lines 3—3 of FIG. 1.
Figure 4:
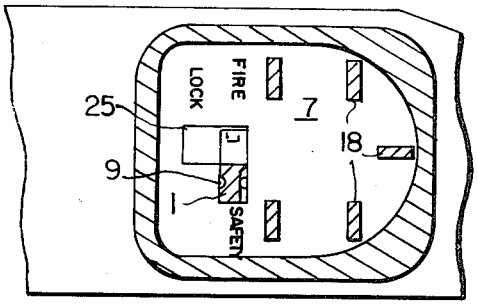
FIG. 4 is a sectional view taken along lines 4—4 of FIG. 3.
Figure 5:
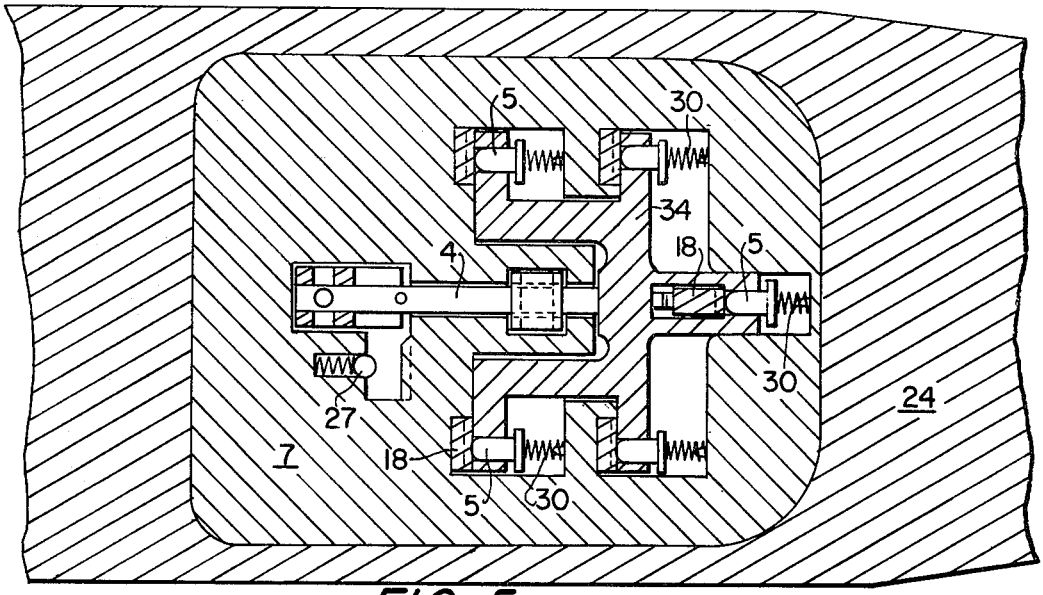
FIG. 5 is a sectional view taken along lines 5—5 of FIG. 3.

A second case occurs when the button is in the locked position, and in this case, vertically downward displacement of the shaft and button 1 and 6 is retarded by means of lip element 25 best seen in FIG. 4 which grips underneath the top head portion of the button 1 and retards downward displacement thereof. The button and shaft 1 and 6 can not be moved forwardly into the firing position until the locking latch 27 is displaced vertically upward (FIG. 3) so that it's coaction against notch 31 has been removed. When the notch is free of the latch 27, the rod element 4 can move forwardly in therefor and so can the shaft 6 and button 1 so that it assumes a substantially vertical orientation. The shaft 6 is provided with an upper pin 16 on shaft 4, a lower pin 12 on the gun stock, an upper slot 17, a lower slot 13 in which these pin elements respectively are constrained whereby the positive and negative vertical displacement of the rod 6 can occur in a controlled manner. Further, the shaft 6 is articulated by a pivot 14 and a mating tongue and slot assembly 15 so that the shaft 6 can be translated from the fire to the safety position disturbing the relationship of latch 27 and notch 31. As pointed out here and before, the dimple 9 and it's cooperation with notch 11 prevents the button 1 from negative vertical displacement and therefor assures that the gun will not be fired at that time.

By way of summary therefor it shall be apparent that there are three modes in which the safety and lock mechanism and firing position of this pin can be oriented. One case occurs when the latch 27 coacts with notch 31 providing a locked arrangement and the button 1 can not pass below the lip element 25 (FIG. 4) to discharge the weapon. The second case is when the button is in the safety position and the shaft 6 is bent or pivoted at point 15 and the shaft 6 is incapable of negative vertical displacement by virtue of dimple 9 coacting against notch 11. The third case occurs when the shaft 6 is substantially linear and the button and shaft are in the firing mode. The gun is then capable of being fired by virtue of the shaft moving downwardly against the lever 8 and it is to be noted that the shaft 6 is constrained to move in a precise fashion by virtue of the pin 16, 12 and slot 17, 13.

Figure 6:
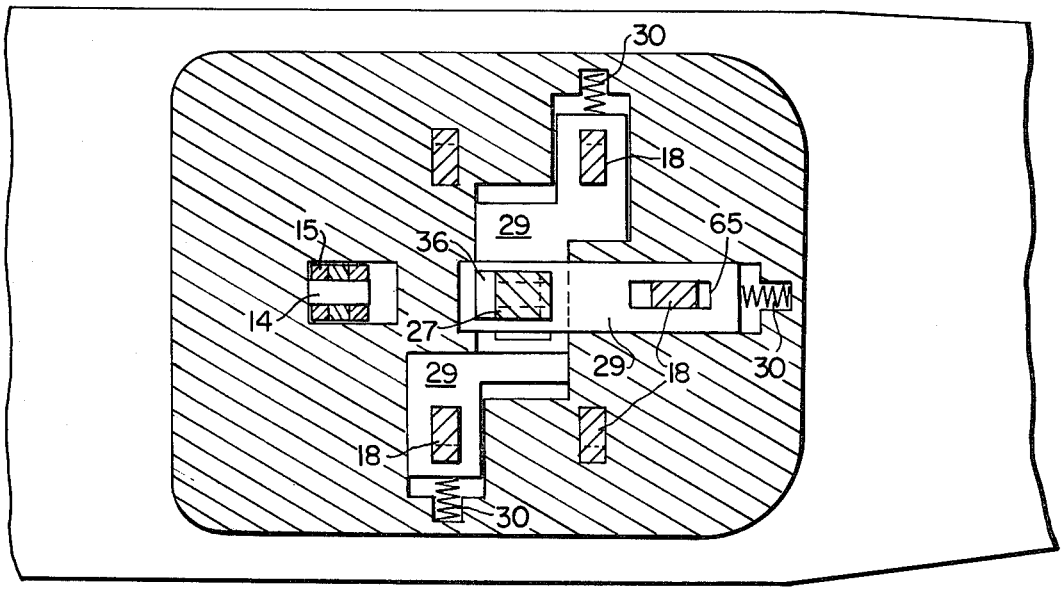
FIG. 6 is a sectional view taken along lines 6—6 of FIG. 3.

The operation of the lock will now be discussed. In a preferred embodiment, the lock is provided with a plurality of buttons 2 disposed on the top face of the rifle, and these buttons 2 communicate with shafts 18 which are normally biased by springs 32 in an upward direction. Each of these shafts 18 is provided with notches 33 as shown in the drawings (FIG. 4), and these notches 33 are adapted to coact with pins 5 disposed within the stock which are biased by spring element 30. In order to fire the gun, the latch 27 has to displace upwardly in a vertical direction, and it is to be appreciated that this latch 27 extends down into the bottom portion of the base 7 of the lock mechanism and is biased by a spring 28. The spring urges the latch upwardly, but positive vertical displacement of the latch 27 can not be effected until a plurality of plates 29 in FIGS. 3 and 6 are juxtaposed in an appropriate fashion that allows 27 to move upwardly. These plates 29 are each biased as by spring elements 30 and therefor the appropriate manipulation of these plates 29 will provide a clear hole or access 36 to allow the latch 27 to be displaced. These plates 29 become suitably oriented when the right combination of keys 2 are downwardly displaced since a portion of the plates 29 ride in notches 33, and these portions 65 are shown in FIG. 3.

When the latch 27 is in its upward most position, the shaft 4 can be translated horizontally from left to right as shown in FIG. 3 and the shaft 4 is connected to a single plate 34 provided with the appropriate projecting pins 5, similar to plates 29 and biasing springs 30. These of course coact with notches 33 also disposed on the shafts 18 so that displacement of this plate in an horizontal sense is possible.

It will be appreciated therefor that some of the shafts 18 will have the appropriate indentations to coact against pins 5, and some of them won't. Whereby when an incorrect orientation of these shafts by virtue of pushing down the wrong buttons 2 has occurred, either the plate 29 associated with that button will not cause registry in the hole so that the latch 27 is capable of vertical displacement or, the upper plate 34 will not benefit from orientation of the pins 5 and their biasing elements against the columns 18 and therefor vertical displacement of the firing pin 6, 1 can not take place since the shaft 4 can not translate horizontally. Since all of these combinations and their pins 2 and 18 are biased in a normally upward direction, only the right sequence or combination of 2, 3 etc. pins will release the plate 34, latch 27, and plates 29 to bring about the unlocking of the weapon. The spring tensioning by means of 32 causes one experimenting with the gun to not feel any difference in attempting to pick the lock between a shaft 18 which has been appropriately oriented in one which is not. The locking block element 7 is suitably disposed in the stock of the gun 24 in any suitable manner.

Having thus described the invention it will be apparent that numerous structural modifications are contemplated as being a part of this invention as delineated here and above and as specified here and below by the claims.

What is claimed is:

1. A gun lock having an individual firing button comprising in combination a firing button, a shaft extending downwardly from said firing button, trigger means connected to said shaft, and lock means connected to said shaft whereby when said lock means is unlocked, said trigger means may be actuated, wherein said lock means includes three positions; a lock, a safety, and a firing position.

2. The device of claim 1 wherein said lock position is provided with a lip which underlies said button and surrounds said shaft to prevent negative vertical displacement of said shaft.

3. The device of claim 2 wherein said safety position comprises a dimple disposed on a housing for the gun coacting with a detent on said shaft to prevent downward vertical displacement of said shaft.

4. The device of claim 3 wherein said lock means includes a second shaft connected to said first named shaft oriented in a horizontal fashion and provided with a notch for registry with a latch which constrains said second shaft from horizontal displacement.

5. The device of claim 4 wherein said latch is upwardly biased by spring means, and said latch will translate upwardly when a plurality of plates disposed between the top portion of said latch and said spring are correctly aligned to thereby provide an unobstructive opening.

6. The device of claim 5 in which said plates are oriented to define the unobstructive hole or opening by means of combination lock pins defined by a top button portion, a downwardly extending shaft for each button, notches disposed on said last names shafts, and pin elements associated with said plate to enter said notches.

7. In the device of claim 6 wherein said pin elements on said plates are spring biased.

* * * * *